US005633630A

United States Patent [19]

Park

[11] Patent Number: 5,633,630

[45] Date of Patent: May 27, 1997

[54] WATCHDOG CIRCUIT OF VEHICLE TRACKING SYSTEM

[75] Inventor: Hyun-Chul Park, Ansan, Rep. of Korea

[73] Assignee: SamSung Electronics Co., Ltd., Kyungki-do, Rep. of Korea

[21] Appl. No.: 810,175

[22] Filed: Dec. 19, 1991

[30] Foreign Application Priority Data

Jan. 29, 1991 [KR] Rep. of Korea ..... 1991-1461

[51] Int. Cl.[6] ..... G08G 1/123

[52] U.S. Cl. ..... 340/992; 375/311; 455/116

[58] Field of Search ..... 340/988, 989, 340/991, 992, 903; 364/424.01, 449, 460; 455/54.1, 99, 116; 342/457; 371/16.3, 62; 375/108, 8, 70, 71, 98, 311; 395/185.08

[56] References Cited

U.S. PATENT DOCUMENTS

| | | | |
|---|---|---|---|
| 3,469,191 | 9/1969 | Russell, Jr. et al. | 455/116 |
| 4,203,070 | 5/1980 | Bowles et al. | 375/76 |
| 4,242,753 | 12/1980 | Dolikian et al. | 455/116 |
| 4,794,620 | 12/1988 | Moore et al. | 455/116 |
| 4,809,280 | 2/1989 | Shonaka | 371/16.3 |
| 4,956,842 | 9/1990 | Said | 371/62 |
| 4,982,404 | 1/1991 | Hartman | 371/62 |
| 5,068,654 | 11/1991 | Husher | 340/991 |
| 5,081,625 | 1/1992 | Rhee et al. | 371/16.3 |
| 5,155,846 | 10/1992 | Mino | 371/16.3 |
| 5,199,007 | 3/1993 | Okano | 371/62 |

*Primary Examiner*—Brent A. Swarthout
*Attorney, Agent, or Firm*—Robert E. Bushnell, Esq.

[57] ABSTRACT

Disclosed is a watchdog circuit of a vehicle tracking system for resetting a microcomputer by sensing a transmission time longer than a predetermined time owing to a false operation of a vehicle mounted equipment in case of transmitting a position signal, and for preventing a malfunction of a vehicle tracking system.

25 Claims, 4 Drawing Sheets

2Tt

Tt

TRANSMITTING MODE
NORMAL MODE

WATCHDOG CIRCUIT OF VEHICLE TRACKING SYSTEM

FIELD OF THE INVENTION

This invention relates to a watchdog circuit of a vehicle tracking system, and more particularly to a watchdog circuit of a vehicle tracking system for resetting a microcomputer by sensing a transmission time longer than a predetermined time in case of a malfunction occurring on a transmission device of a vehicle.

TECHNICAL BACKGROUND OF THE INVENTION

Generally, a vehicle tracking system comprises a central control station CCS, a plurality of base stations Sl–Sn, and equipment mounted on a vehicle as shown in FIG. 1. When a user requests the central control station CCS to inform him of a position of a vehicle, the central control station CCS transmits a call signal, including an identification number of the vehicle, through a call antenna. The equipment mounted on the vehicle transmits a signal showing its position to the central control station CCS after receiving the call signal including its identification number, and the central control station CCS informs the user of the position of the vehicle by determining the position after receiving the signal. The operation as described in the above statement is performed by a time sharing method as shown in FIG. 2, and every frame is allocated with an address of a vehicle subscriber. The equipment mounted on the vehicle shows its position when a predetermined time has elapsed after receiving a call signal. Because a transmission time is predetermined, the central control station CCS receives a transmission signal from the equipment mounted on the vehicle during a predetermined time for the vehicle. An emergency signal for notifying of an emergency situation of a vehicle is to be transmitted from a frame No. "1" as shown in FIG. 2.

Every frame of a plurality of vehicle subscribers is allocated with its exclusive address. The central control station CCS calls a series of addresses sequentially and receives a signal of position corresponding to a called address sequentially after a predetermined time has elapsed. Accordingly, if trouble occurs on the equipment mounted on the vehicle, the vehicle tracking system is not usable because the transmission time for a position signal is longer than a predetermined time.

SUMMARY OF THE INVENTION

An object of the present invention is to provide a watchdog circuit of a vehicle tracking system for resetting a microcomputer by sensing a transmission time longer than a predetermined time owing to malfunction of vehicle mounted equipment in the case of transmitting a position signal.

Another object of the present invention is to provide a watchdog circuit for preventing a malfunction of a vehicle tracking system.

According to the present invention, a watchdog circuit of a vehicle tracking system comprises a microcomputer 10, a code modulator and amplifier circuit 20, a high-frequency power amplifier 30, a first timer 40, an AND gate AN1, a driving circuit 50, a second timer 60 and a reset signal generating circuit 70. The microcomputer 10 controls the equipment mounted on a vehicle. The code modulator and amplifier circuit 20 modulates a PRN (Pseudo Random) code according to the control signal received from the microcomputer 10 and then amplifies the modulated signal. The high-frequency power amplifier 30 receives the amplified signal from the code modulator and amplifier circuit 20 and then amplifies the high-frequency component of the received signal, and transmits the high-frequency amplified signal through an antenna ANT1. The first timer 40 receives a power amplification control signal PAW outputted from the microcomputer 10 and counts the time ($2T_t$) for transmitting two frames, and then outputs the counted value. The AND gate AN1 receives the counted value outputted from the timer 40 and the power amplification control signal outputted from the microcomputer 10 and then generates a transmission interruption control signal. The driving circuit 50 receives the transmission interruption control signal from the AND gate AN1, thereby stopping an operation of the high frequency power amplifier 30. The second timer 60 receives the output signal of the first timer 40 and counts the time ($T_t$) for transmitting one frame, and then outputs the counted value. The reset signal generating circuit 70 receives the output signal of the second timer 60 and the power amplification control signal PAW outputted from the microcomputer 10 and then supplies a reset signal into the reset terminal of the microcomputer 10.

The present invention will now be described more specifically with reference to the drawings attached only by way of example.

DETAILED DESCRIPTION OF THE PREFERRED EMBODIMENTS

Figure 1:
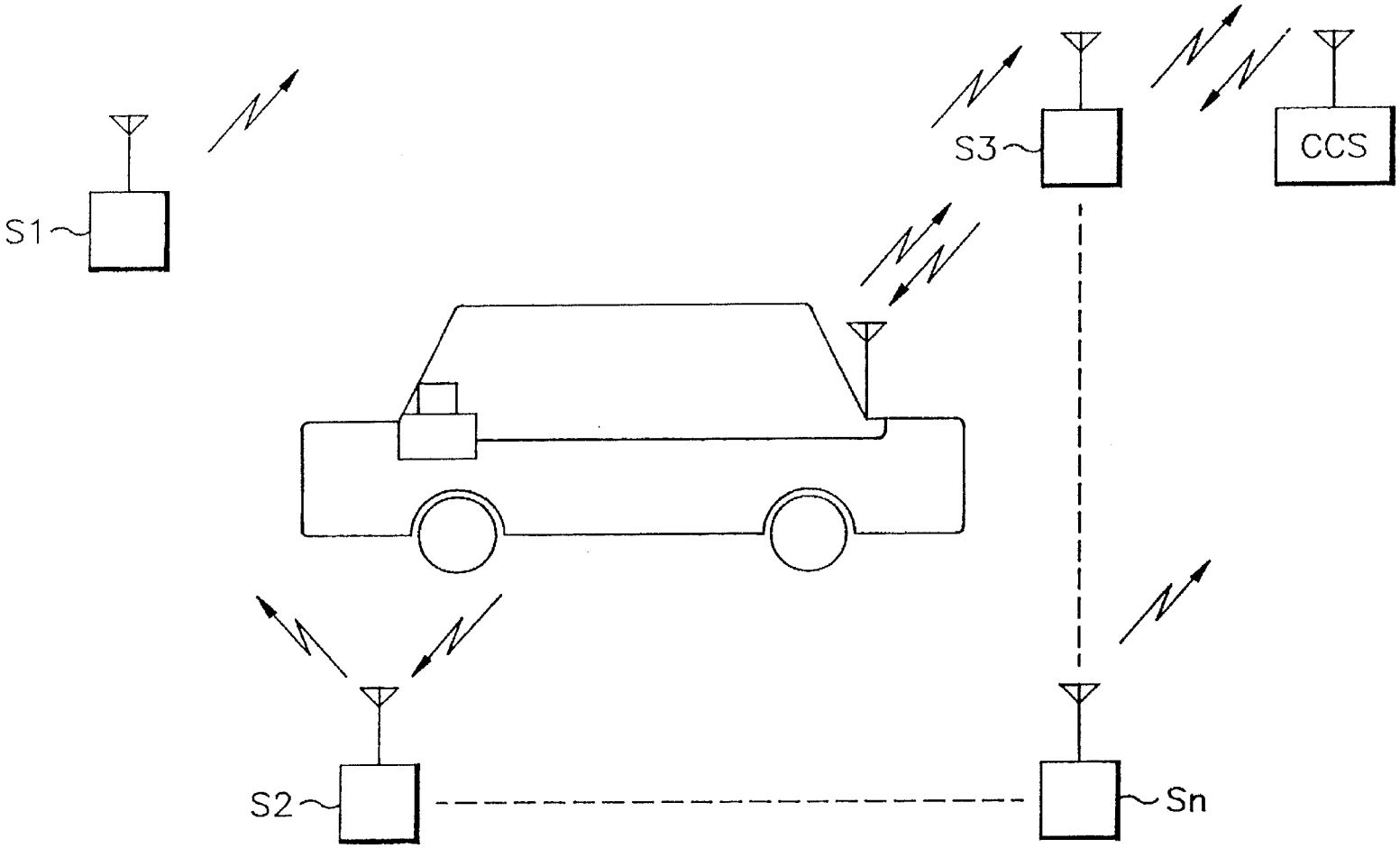
FIG. 1 is a schematic diagram of a conventional vehicle tracking system.
Figure 2:
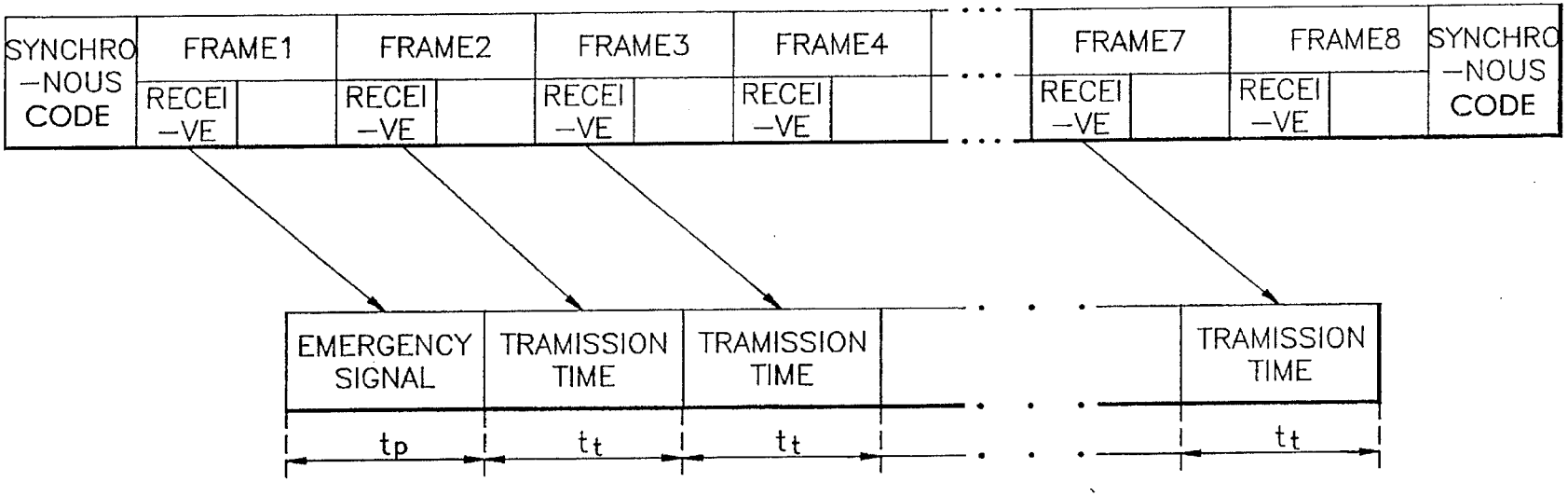
FIG. 2 is a timing diagram of transmission and reception of a conventional vehicle tracking system.
Figure 3:
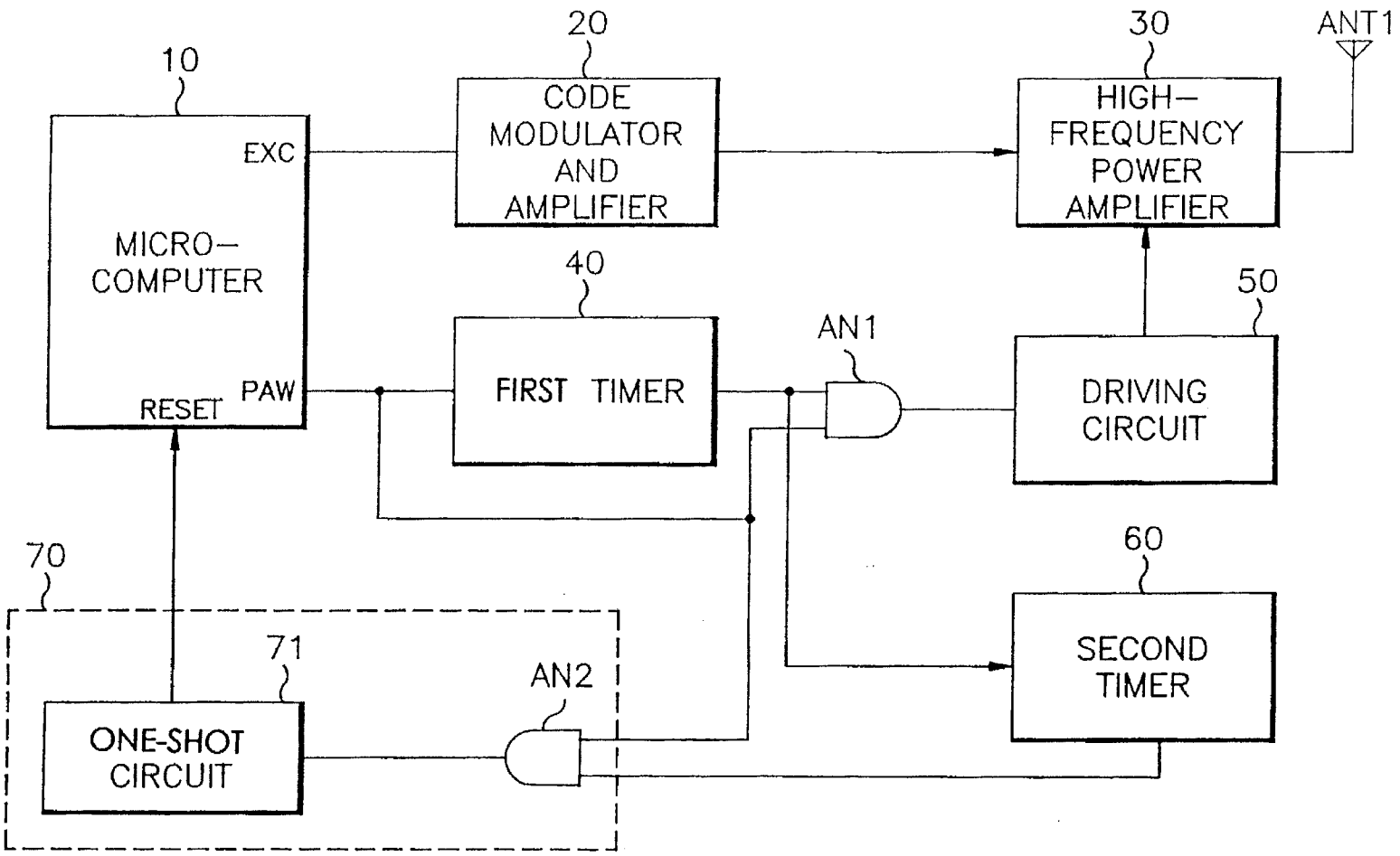
FIG. 3 is a circuit diagram of the vehicle tracking system according to the present invention.

Referring to FIG. 3, a microcomputer 10 controls equipment mounted on a vehicle, and a code modulator and amplifier 20 modulates and amplifies a pseudo-random code (PRN) according to a control signal of the microcomputer 10. A high-frequency power amplifier 30 amplifies a high frequency component of the PRN code signal modulated and amplified by the code modulator and amplifier 20 and transmits it through an antenna ANT 1. A first timer 40 transmits a signal by counting the time for transmitting two frames $2T_t$ after receiving a power amplification control signal PAW from the microcomputer 10. An AND gate AN1 generates a transmission interruption control signal for the high-frequency power amplifier 30 by receiving a counted signal from the first timer 40 and a power amplification control signal PAW from the microcomputer 10. A driving circuit 50 turns off an operation of the high-frequency power amplifier 30 by receiving a transmission interruption control signal from the AND gate AN1. A second timer 60 transmits a signal by counting for a frame transmission time $T_t$ after receiving the output signal of the first timer. A reset signal generator 70 generates a reset signal for the microcomputer 10 by receiving the counted signal from the second timer 60 and the power amplification control signal PAW from the microcomputer 10.

Figures 4A, 4B, 4C, 4D, 4E, 4F, 4G:
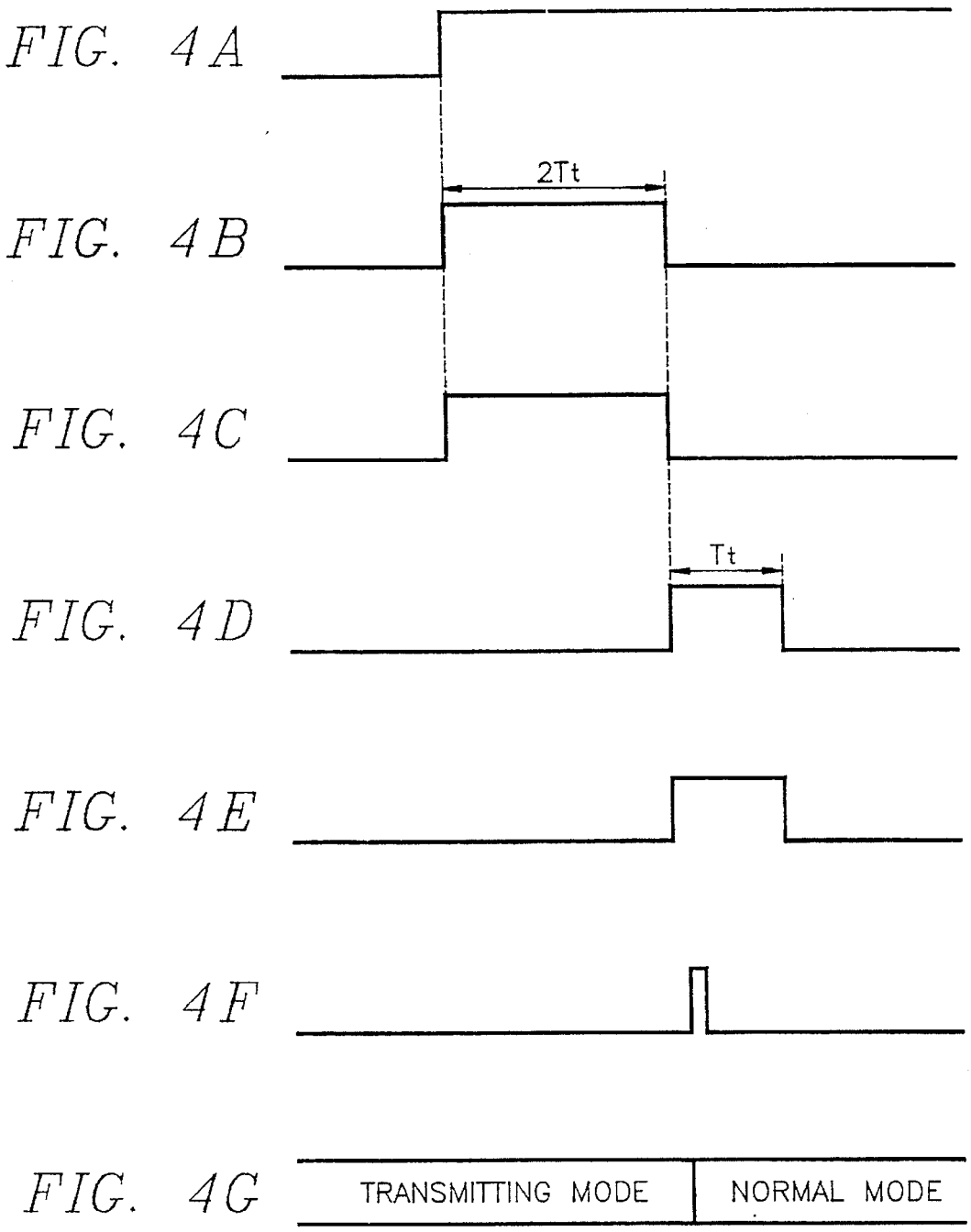
FIGS. 4A through 4G are operation waveforms of the circuit of FIG. 3

Referring to FIGS. 3 and 4, an operation is described specifically as follows. The microcomputer 10 controls a transmission operation of the high-frequency power amplifier 30 for a frame transmission time $T_t$ or an emergency signal transmission time. If the microcomputer 10 transmits a signal as shown in FIG. 4A owing to a fault caused by static electricity or any other cause, the first timer 40 transmits a high level signal as shown in FIG. 4B during the time for transmitting two frames $2T_t$ by counting. The AND gate AN1 transmits a signal as shown in FIG. 4C by receiving the signal from the first timer 40 as shown in FIG. 4B and the signal from the microcomputer 10 as shown in FIG. 4A. The driving circuit 50 drives the high-frequency power amplifier 30 to transmit a signal during the time for transmitting two frames $2T_t$ by receiving an output signal of the AND gate AN1. Therefore, a transmission is not performed over a time twice a frame transmission time $2T_t$ even if a false operation occurs in the microcomputer 10.

The second timer 60 generates a signal as shown in FIG. 4D by counting for a frame transmission time $T_t$ after receiving the signal from the first timer 40 as shown in FIG. 4B. The AND gate AN2 generates a reset generation control signal by receiving the signal from the second timer 60 as shown in FIG. 4D and the signal from the microcomputer 10 as shown in FIG. 4A. One-shot circuit 71 generates a signal as shown in FIG. 4F so as to reset the microcomputer 10 by receiving the high level signal from the AND gate AN2. If the microcomputer 10 transmits a high level signal of power amplification control signal PAW to the first timer 40 continuously during the time for transmitting two frames $2T_t$ and continues to transmit a high level signal after a frame transmission time is elapsed in the second timer 60, the AND gate AN2 generates a reset generating signal so as to make the one-shot circuit 71 transmit a signal for resetting the microcomputer 10. Therefore, a transmission mode returns to a normal mode as shown in FIG. 4G when the one shot circuit 71 generates a signal as shown in FIG. 4F.

In conclusion, the watchdog circuit cuts off a transmission automatically by sensing a transmission time longer than a predetermined time of transmission owing to a false operation of a transmission device of a vehicle, and improves a function of a vehicle tracking system by resetting the microcomputer of the equipment mounted on the vehicle.

What is claimed is:

1. A watchdog circuit of a vehicle tracking system, comprising:

a microcomputer;

a code modulation and amplification circuit;

a high-frequency power amplifier;

a first timer for transmitting a first timed signal by counting during a time period for transmitting two frames of tracking data after receiving a power amplification control signal from said microcomputer;

a first logic gate for generating a transmission interruption control signal for said high-frequency power amplifier in response to said first timed signal counted during the time for transmitting two frames by said first timer and said power amplification control signal from said microcomputer;

a driving circuit for turning off said high-frequency power amplifier in response to said transmission interruption control signal from said first logic gate;

a second timer for transmitting a second timed signal for a frame transmission time after receiving said first timed signal counted during the time for transmitting two frames; and a reset signal generator for generating a reset signal for resetting said microcomputer in response to said second timed signal counted for a frame transmission time by said second timer and said power amplification control signal from said microcomputer.

2. A watchdog circuit of a vehicle tracking system as claimed in claim 1, wherein said reset signal generator comprises:

a second logic gate for generating a reset generation control signal in response to said second timed signal and said power amplification control signal of said microcomputer; and a one-shot circuit for generating said reset signal according to said reset generation control signal.

3. A cut-off circuit of a vehicle tracking system having a central control station, said cut-off circuit comprising:

microprocessing means for generating a control signal and a power amplification control signal;

code modulation and amplification means for generating a modulated signal by modulating and amplifying an intermediate signal in response to said control signal;

high frequency amplification means for amplifying said modulated signal for transmission via an antenna to said central control station;

first timing means for generating a first timed signal for a first predetermined time period in response to said power amplification control signal;

first logic means for generating a transmission interruption control signal in response to said first timed signal and said power amplification control signal;

driving means for turning off said high frequency amplification means to disable transmission of said modulated signal in response to said transmission interruption control signal;

second timing means for generating a second timed signal a second predetermined time period after said first timed signal; and reset signal generating means for resetting said microprocessing means from a first mode to a second mode in response to said second timed signal and said power amplification control signal.

4. The cut-off circuit as claimed in claim 3, wherein said reset signal generating means comprises:

second logic means for generating a reset generation control signal in response to said power amplification control signal and said second timed signal; and means for generating a reset pulse in response to said reset generation control signal, to reset said microprocessing means.

5. The cut-off circuit as claimed in claim 3, wherein said intermediate signal is a pseudo-random code signal.

6. The cut-off circuit as claimed in claim 3, wherein said first timing means generates said first timed signal for a period of time substantially the same as a time period necessary for transmitting two frames of tracking data.

7. The cut-off circuit as claimed in claim 3, wherein said second timing means generates said second timed signal for a period of time substantially the same as a time period necessary for transmitting one frame of tracking data.

8. The cut-off circuit as claimed in claim 3, wherein said first mode of said microprocessing means is a transmission mode and said second mode is a non-transmission mode.

9. The cut-off circuit as claimed in claim 4, wherein said first timing means generates said first timed signal for a period of time substantially the same as a time period necessary for transmitting two frames of tracking data and said second timing means generates said second timed signal for a period of time substantially the same as a time period necessary for transmitting one frame of tracking data.

10. The cut-off circuit as claimed in claim 3, wherein said microprocessing means generates said control signal during said first mode and said microprocessing means does not generate said control signal during said second mode.

11. A cut-off circuit of a vehicle tracking system including a central control station, said cut-off circuit comprising:

microprocessing means for generating a control signal and a power amplification control signal during a transmission mode for transmission of tracking data;

code modulation and amplification means for generating a modulated signal by amplifying and modulating an intermediate signal in response to said control signal;

high frequency amplification means for amplifying a high frequency component of said modulated signal and transmitting the amplified high frequency component via an antenna to the central control station;

transmission interruption means for turning off said high frequency amplification means after a first time interval counted from the generation of said power amplification control signal, said transmission interruption means comprising first timing means for generating a first timed signal in response to said power amplification control signal, first logic means for generating a transmission interruption control signal in response to said first timed signal and said power amplification control signal, and driving means for turning off said high frequency amplification means in response to said transmission interruption control signal;

second timing means for generating a second timed signal after said first time interval; and mode reset means, connected to said transmission interruption means and said microprocessing means, responsive to said second timing means for resetting said microprocessing means from said transmission mode to a non-transmission mode in response to said second timed signal.

12. The cut-off circuit as claimed in claim 11, wherein said mode reset means comprises:

second logic means for generating a reset generation control signal in response to said power amplification control signal and said second timed signal; and means for generating a reset signal in response to said reset generation control signal to reset said microprocessing means from said transmission mode to said non-transmission mode.

13. A cut-off circuit of a vehicle tracking system including a central control station, said cut-off circuit comprising:

microprocessing means for generating a control signal and a power amplification control signal during a transmission mode for transmission of tracking data;

code modulation and amplification means for generating a modulated signal by amplifying and modulating an intermediate signal in response to said control signal;

high frequency amplification means for amplifying a high frequency component of said modulated signal and transmitting the amplified high frequency component via an antenna to the central control station;

first timing means for generating a first timed signal for a first interval that is substantially equal to a time period for transmission of two frames of tracking data to the central control station, in response to said power amplification control signal;

first logic means for generating a transmission interruption control signal in response to said first timed signal and said power amplification control signal;

driving means for turning off said high frequency amplification means in response to said transmission interruption control signal;

second timing means for generating a second timed signal for a second interval that is substantially equal to a time period for transmission of one frame of tracking data to the central control station, after said first interval in response to said first timed signal; and reset signal generating means for resetting said microprocessing means from said transmission mode to a non-transmission mode during said second interval in response to continued generation of said power amplification control signal after said first interval.

14. The cut-off circuit as claimed in claim 13, wherein said reset signal generating means comprises:

second logic means for generating a reset generation control signal in response to said power amplification control signal and said second timed signal; and means for generating a reset pulse in response to said reset generation control signal.

15. The cut-off circuit as claimed in claim 14, wherein said first timing means generates said first timed signal for a period of time substantially the same as a time for transmitting two frames of tracking data.

16. The cut-off circuit as claimed in claim 4, wherein said first timing means generates said first timed signal for a period of time substantially the same as a time for transmitting two frames of tracking data and said second timing means generates said second timed signal for a period of time substantially the same as a time for transmitting one frame of tracking data.

17. The cut-off circuit as claimed in claim 16, wherein said first and second logic means comprise a first and a second AND gate, respectively.

18. The cut-off circuit as claimed in claim 14, wherein said first and second logic means comprise a first and a second AND gate, respectively.

19. A process for preventing malfunction of a vehicle tracking device including a microcomputer for generating a power amplification control signal during a transmission mode for transmission of tracking data, a modulator responsive to said microcomputer for modulating pseudo random code to generate pseudo random code signals, and a high frequency power amplifier for amplifying said pseudo random code signals for transmission to a central control station, said process including:

counting a transmission time of two successive frames of track data for a first time period by a first timer in response to said power amplification control signal;

disabling operation of said high frequency power amplifier from transmitting said pseudo random code signals to the central control station in response to expiration of said first time period;

counting a transmission time of a single frame of track data for a second time period by a second timer in response to expiration of said first time period; and generating a reset signal for resetting said microcomputer from said transmission mode to a non-transmission mode upon initiation of said second time period in response to continued generation of said power amplification control signal by said microcomputer during said second time period.

20. A process as claimed in claim 19, further comprised of said reset signal being generated by a serially connected AND gate and a one-shot circuit responding to said continued generation of said power amplification control signal and to said expiration of said second time period.

21. A process as claimed in claim 19, further comprised of said first time period being substantially twice longer than said second time period.

22. A vehicle tracking device including a central control station, comprising:

first means for generating a modulation control signal and a power amplification control signal during a first operational mode enabling transmission of tracking data;

second means for modulating pseudo random code signals indicative of said tracking data in response to said modulation control signal;

third means for amplifying said modulated pseudo random code signals for radio frequency transmission to the central control station;

fourth means comprising a first timer for generating a first counting signal continuously for only a first time period counted in response to generation of said power amplification control signal;

fifth means comprising a first logic gate for generating a transmission interruption control signal in response to a logical combination of said first counting signal and said power amplification control signal to disable said third means from amplifying said pseudo random code signals for radio frequency transmission to the central control station when said first counting signal indicates expiration of said first time period; and sixth means for responding to said power amplification control signal after indication by said first counting signal of said expiration of said first time period by generating a reset signal to reset said first means from said first operational mode to a second operational mode discontinuing generation of said modulation control signal and said power amplification control signal.

23. A vehicle tracking device as claimed in claim 22, further comprised of said first time period corresponding to a time required for transmitting two successive frames of tracking data.

24. A vehicle tracking device as claimed in claim 22, further comprised of said first logic gate of said fifth means corresponding a AND gate.

25. A vehicle tracking device as claimed in claim 23, wherein said sixth means comprises a second timer for generating a second counting signal continuously for only a second time period in response to said first counting signal indicating expiration of said first time period;

a second logic gate for generating a reset generation control signal in response to a logical combination of said second counting signal and said power amplification control signal; and one-shot means for generating said reset signal to reset said first means from said first operational mode to said second operational mode in response to said reset generation control signal.

* * * * *